US008162679B2

(12) United States Patent
Ko et al.

(10) Patent No.: US 8,162,679 B2
(45) Date of Patent: Apr. 24, 2012

(54) INSULATION DISPLACEMENT CONTACT AND ELECTRIC CONNECTOR USING THE SAME

(75) Inventors: David Ko, Fullerton, CA (US); Hong-Wei Sun, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 259 days.

(21) Appl. No.: 12/482,492

(22) Filed: Jun. 11, 2009

(65) Prior Publication Data

US 2009/0311888 A1 Dec. 17, 2009

(30) Foreign Application Priority Data

Jun. 11, 2008 (CN) ..... 2008 2 0301117

(51) Int. Cl.
*H01R 12/00* (2006.01)

(52) U.S. Cl. ..... 439/79; 439/401

(58) Field of Classification Search ..... 439/157, 439/397–401

See application file for complete search history.

(56) References Cited

U.S. PATENT DOCUMENTS 4,255,009 A * 3/1981 Clark ..... 439/398
4,820,179 A * 4/1989 Saijo ..... 439/224
6,086,405 A * 7/2000 Liebich ..... 439/397
6,280,230 B1 * 8/2001 Takase et al. ..... 439/397
D464,322 S * 10/2002 Hiramoto et al. ..... D13/154
7,056,146 B2 * 6/2006 Hiramoto et al. ..... 439/397
D555,092 S * 11/2007 Li et al. ..... D13/133
7,354,295 B2 * 4/2008 Tashiro et al. ..... 439/397

* cited by examiner

*Primary Examiner* — Tulsidas C Patel
*Assistant Examiner* — Travis Chambers
(74) *Attorney, Agent, or Firm* — Wei Te Chung; Andrew C. Cheng; Ming Chieh Chang

(57) ABSTRACT

An electric connector for mating with a complementary connector includes an insulation housing, at least an insulation displacement contact, and at least an insulated wire. The insulation housing includes two rows of contact holding portions which are respectively arranged on an upper and lower side of the insulation housing, and two rows of cable holding portions. The cable holding portions are arranged in correspondence with the contacting holding portions and each connected to its corresponding contacting holding portion for forming a passageway along a mating direction. The insulation displacement contact is holed in one of the contact holding portion. The insulated wire extends along the mating direction. And the wire includes a front portion inserted into one of the insulation displacement contact along a vertical direction and a sub-front portion received in one of the cable holding portions along the vertical direction.

4 Claims, 7 Drawing Sheets

3

INSULATION DISPLACEMENT CONTACT AND ELECTRIC CONNECTOR USING THE SAME

BACKGROUND OF THE INVENTION

1. Field of the Invention

The present invention relates generally to an insulation displacement contact (IDC) and an electric connector using the same. Specially, each IDC contact includes at least a pair of conductor termination slots readily terminating a conductive wire attached thereto.

2. Description of the Prior Art

A connector to be attached to an insulated wire has a resin housing and a contact (terminal metal fitting) secured to the housing. An IDC contact is featured with a slot in which when a conductive wire is disposed within the slot, insulative jacket of the conductive wire be pierced through by edges of the slot. As a result, not only will the conductive wire be held therein, electrical interconnection between the IDC contact and the conductor within the wire is also established. When such an insulation displacement contact is used, the contact and the core wire portion of the insulated wire can be electrically connected to each other merely by pushing the insulated wire into the slot of the insulation displacement contact. A connector using such an insulation displacement contact is called an insulation displacement connector.

U.S. Pat. No. 7,056,146 issued to Hiramoto on Oct. 6, 2005 discloses a connector utilizing the IDC contact terminal which is arranged such that the conductive wires is in alignment with the mating direction, see FIGS. 1, 4 and 8. According to the disclosure, a pair of contact engaging arms each made of a plate member is connected to an outer side of each insulation displacement portion, see either FIG. 4 or 8. From the disclosures of FIGS. 4 and 8, it looks like that the interconnection between the contact engaging arms and the outer side of the portions is thinner as compared to the rest of the contact. It is suspicious that the resilient contact arms will survive during its life span in view of mating and disengaging with a mating connector.

Hence, in this art, an insulation displacement contact to overcome the above-mentioned disadvantages of the prior art should be provided.

BRIEF SUMMARY OF THE INVENTION

A primary object, therefore, of the present invention is to provide an electric connector with improved insulation displacement contact.

In order to implement the above object, the electric connector comprises an insulation housing, at least an insulation displacement contact, and at least an insulated wire. The insulation housing comprises two rows of contact holding portions which are respectively arranged on an upper and lower side of the insulation housing, and two rows of cable holding portions which are arranged in correspondence with the contacting holding portions and each connected to its corresponding contacting holding portion for forming a passageway along a mating direction. The insulation displacement contact is holed in one of the contact holding portion. The insulated wire extends along the mating direction. And the wire includes a front portion inserted into one of the insulation displacement contact along a vertical direction and a sub-front portion received in one of the cable holding portions along the vertical direction.

Other objects, advantages and novel features of the invention will become more apparent from the following detailed description of a preferred embodiment when taken in conjunction with the accompanying drawings.

DETAILED DESCRIPTION OF THE INVENTION

Figure 1:
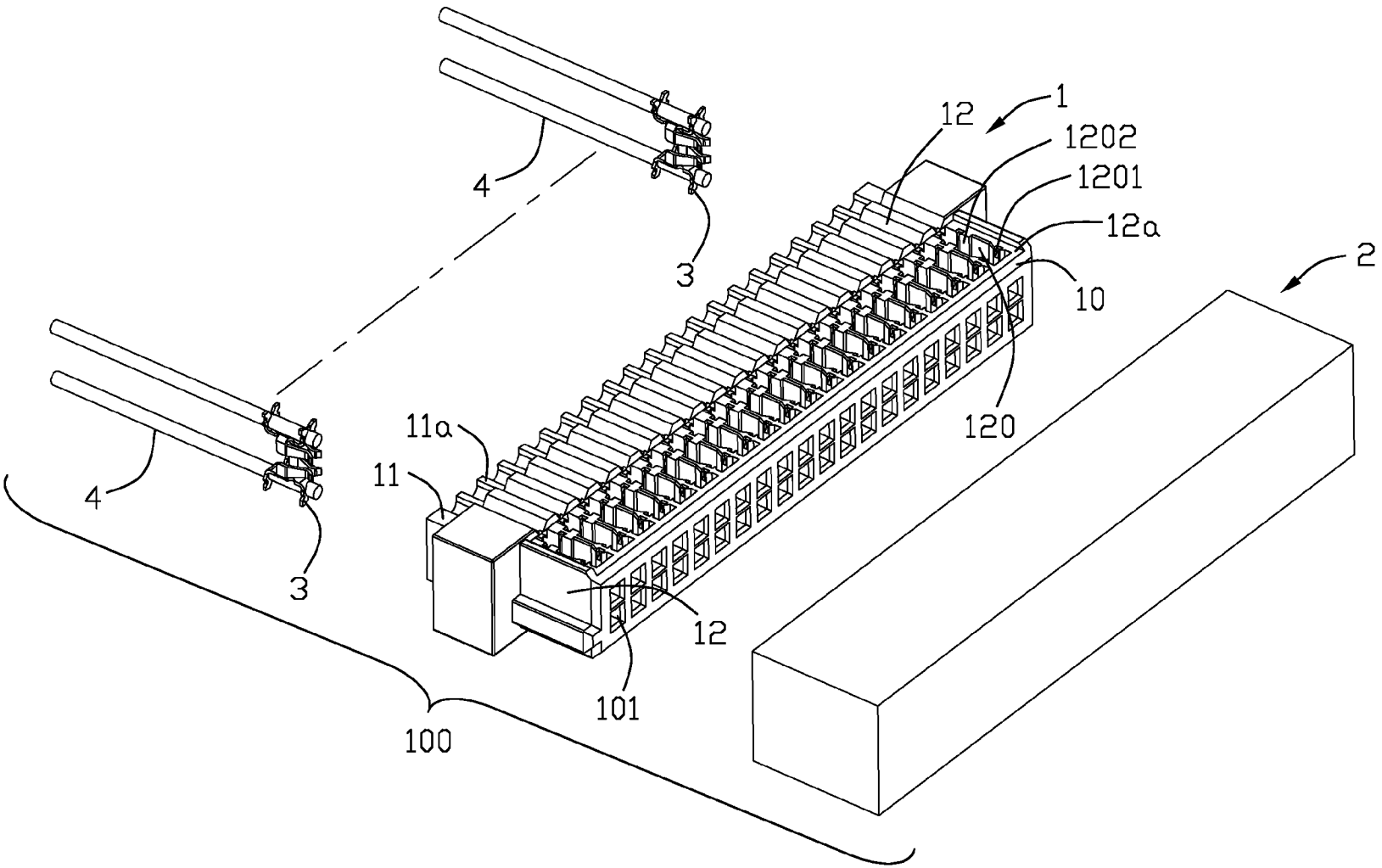
FIG. 1 is a exploded, perspective view illustrating how to use an electric connector according to a preferred embodiment of the present invention.
Figure 2:
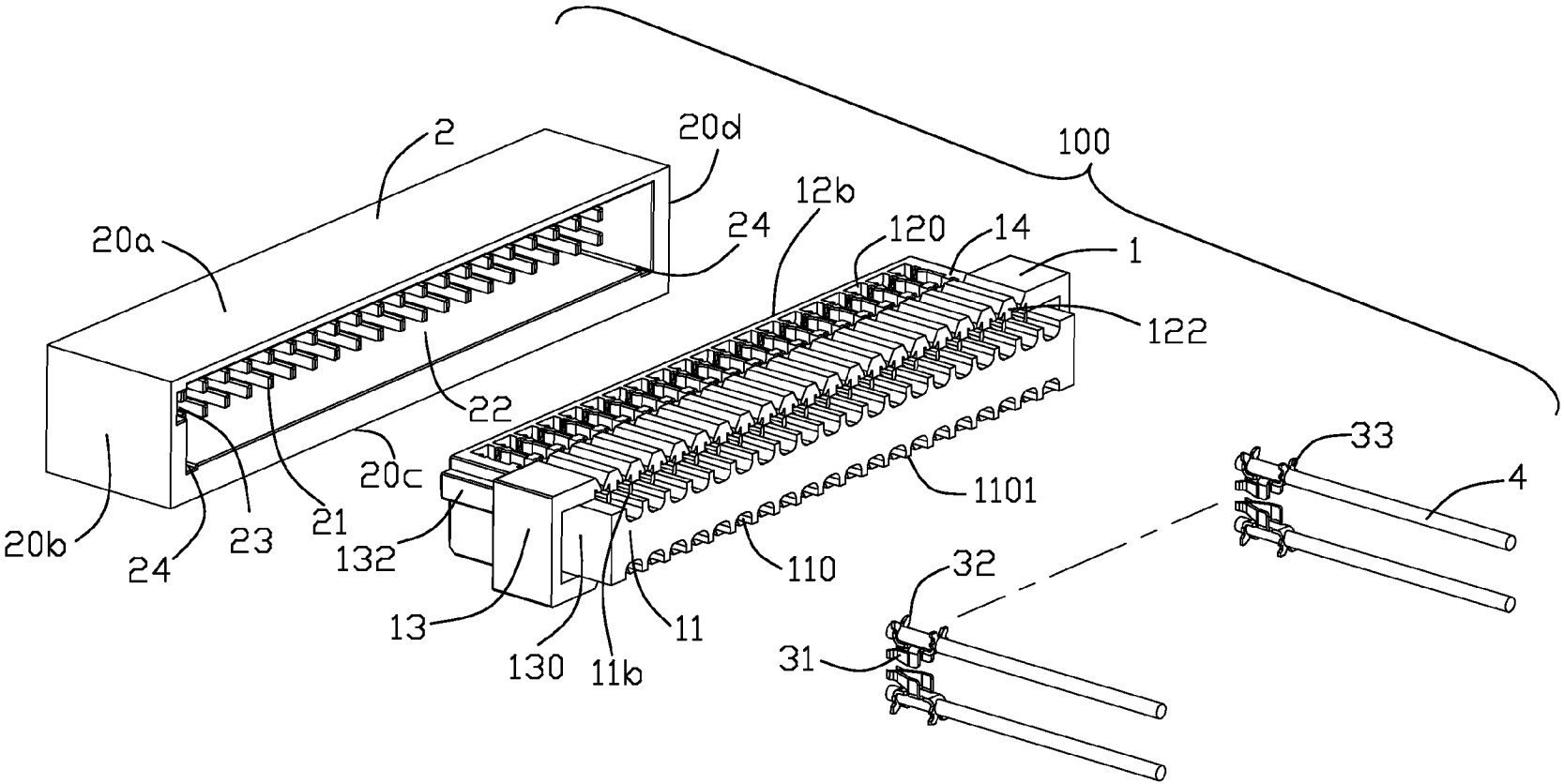
FIG. 2 is a exploded, perspective view similar to FIG. 1, but viewed from another angle.
Figure 3:
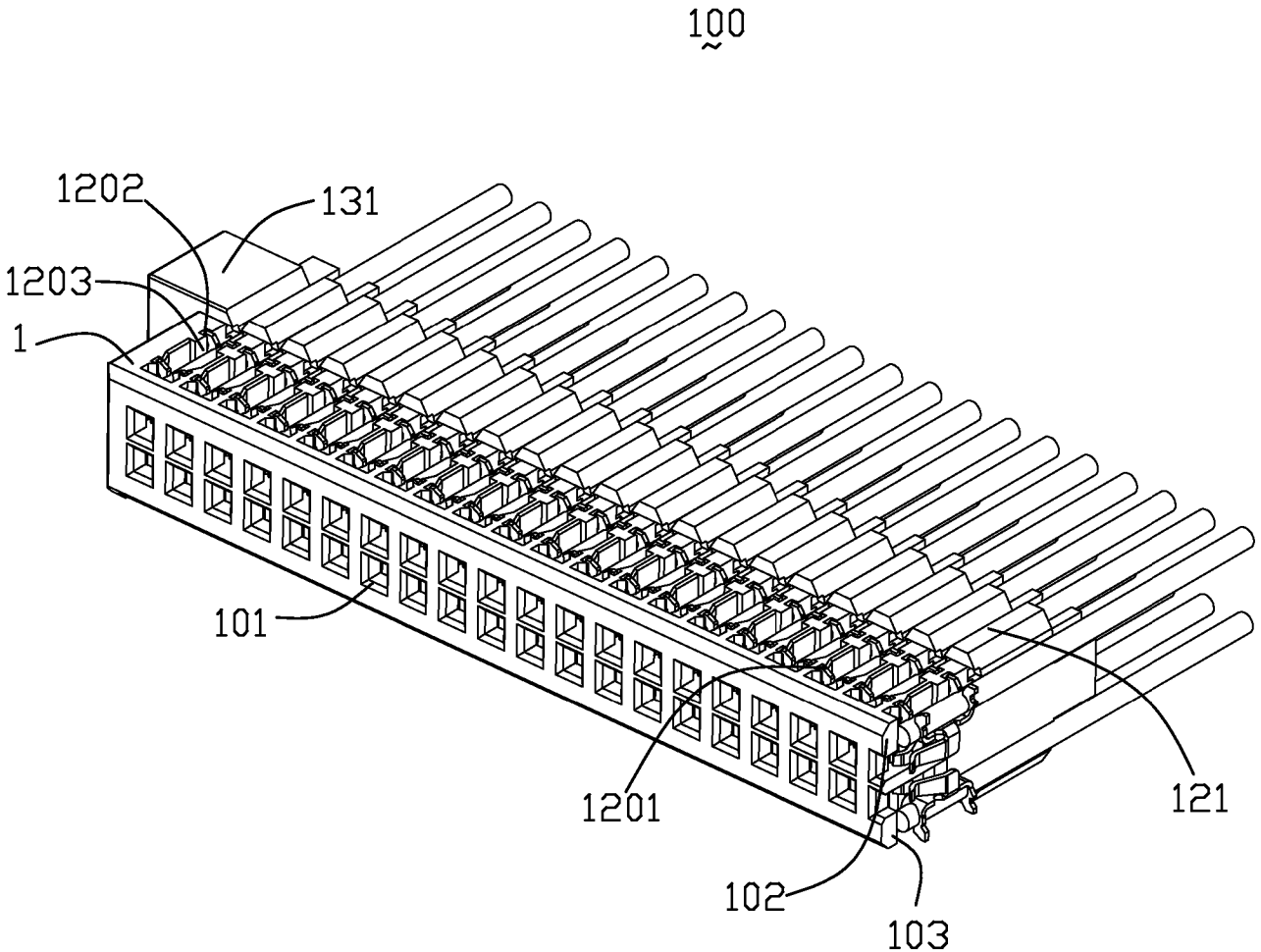
FIG. 3 is a perspective view illustrating a housing, and contacts, wires fitted to each other.
Figure 4:
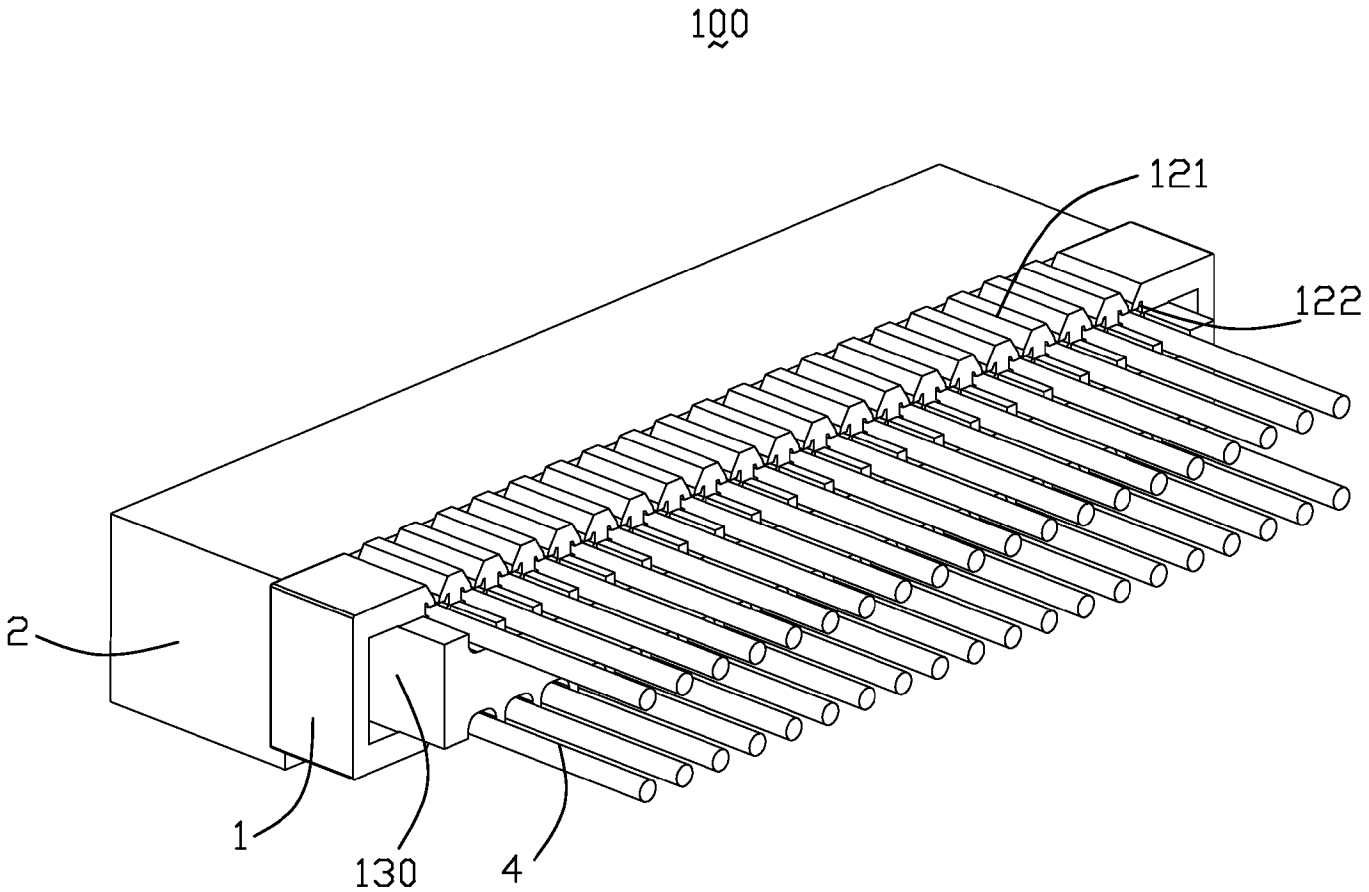
FIG. 4 is a perspective view illustrating how to use an electric connector according to a preferred embodiment of the present invention.

Reference will now be made in detail to a preferred embodiment of the present invention.

Reference to FIGS. 1 to 5, an electric connector 100 with insulation displacement contacts in according with a preferred embodiment of the present invention is shown. The electric connector 100 comprises an insulation housing 1, two rows of contacts 3 received in the housing 1, and a plurality of wires 4 respectively terminated in the contacts. The electric connector 100 is used to mate to the complementary connector 2. The complementary connector 2 is substantially of rectangular shape and includes a receiving space 22 and four walls 20*a*, 20*b*, 20*c*, 20*d* surrounding the receiving space 22. Two rows complementary contacts 21 are received in the receiving space 22 and each extends along a mating direction. A guiding groove 23 is defined on the first wall 20*b* and extends along the mating direction. A pair of fixing grooves 24 is respectively formed on the two sides of the third wall 20*c* and respectively communicates the second wall 20*b* and the fourth wall 20*d* with the third wall 20*c*.

Referencing to FIGS. 1 to 4, a front wall 10 is formed in the front of the insulation housing 1. The insulation housing 1 comprises a contact holding portion 12 in the front thereof and a cable holding portion 11 in the rear thereof. Two rows of holes 101 are arranged on the front wall of the housing 1 along an arranging direction which is perpendicular to the mating direction. Two rows of contact holding grooves 120 are respectively arranged on the upper and lower surfaces of the contact holding portion 12 in corresponding with the holes 101, and each is connected to its corresponding hole 101 in the mating direction. Two rows of cable holding grooves 110 are respectively corresponding to the contact holding grooves 120 along the mating direction, and each is connected to its corresponding contact holding portion 12. The contact holding portion 12 has an upper surface 12*a* higher than the same of the cable holding portion 11*a*. And the contact holding portion 12 has a lower surface 12*b* lower than the same of the cable holding portion 11*b*. Each two cable holding grooves 110 form a cable holding groove wall 1101. Each cable holding groove wall 1101 defines a limiting block 121 on the top and front part thereof. The limiting block 121 has a pair of limbs 1210 on the two sides thereof. The pair of limbs 1210 respectively and aslant extends from the two sides of the top of the limiting block 121 toward the cable holding grooves 110 for limiting the wires. Every two relative limbs 1210 located above one same cable holding groove 110 form a funnel-form passageway. When a conductive wire 4 is inserted into the cable holding groove 110 through the funnel-form passageway, said wire cannot move away from said cable holding groove 110 through said funnel-form passageway. The contact holding portion 12 comprises an anti-mismatch portion 132 located on one side thereof for avoiding mismatch between the electric connector 100 and the complementary connector 2. The anti-mismatch portion 132 extends along the mating direction and corresponds to the guiding groove 23 of the complementary connector 2. The contact holding groove 120 has two pair of fastening portions 1201, 1202 spaced apart from each other. Each fastening portion 1201 (1202) has a receiving cutout 1201*a* (1202*a*) on the top thereof.

Figure 5:
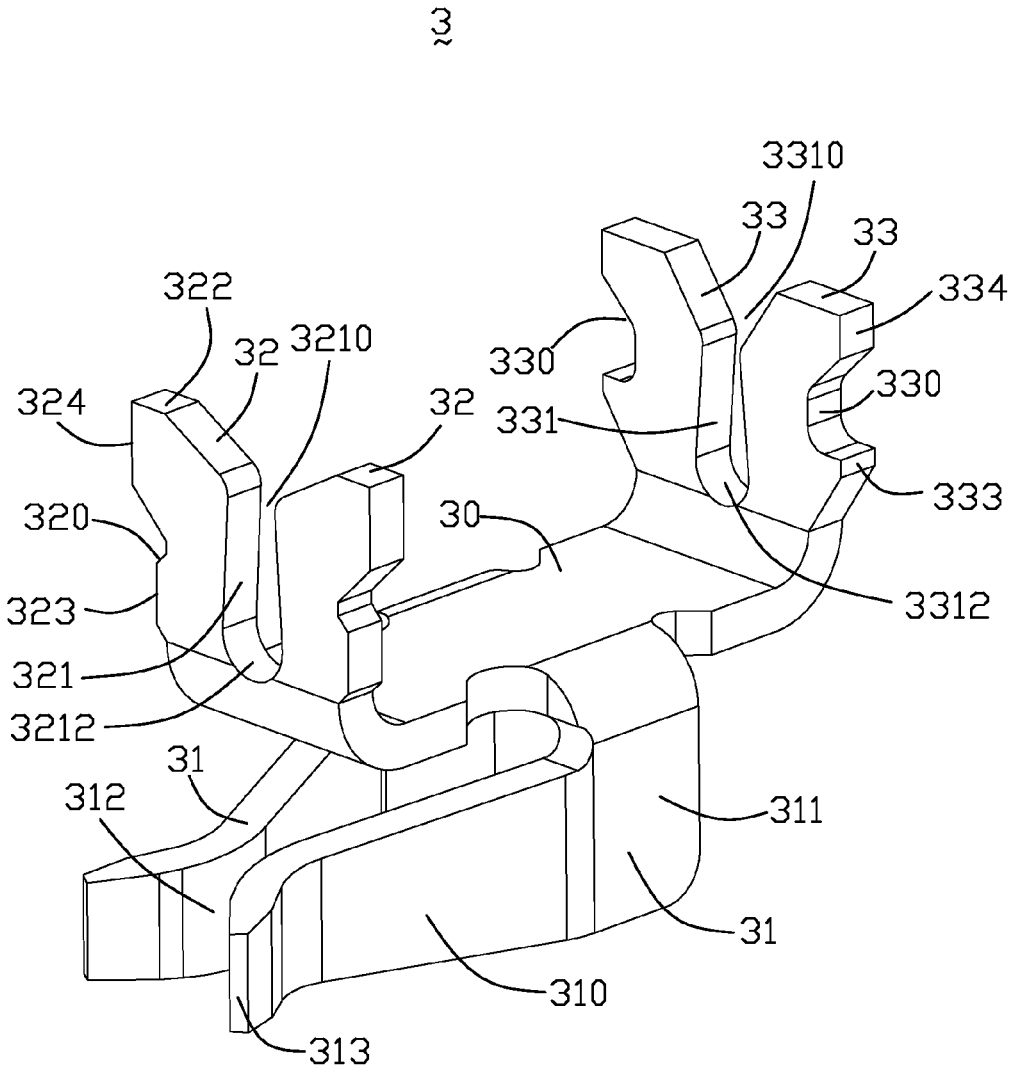
FIG. 5 is a perspective view of an insulation displacement contact of the present invention.
Figure 6:
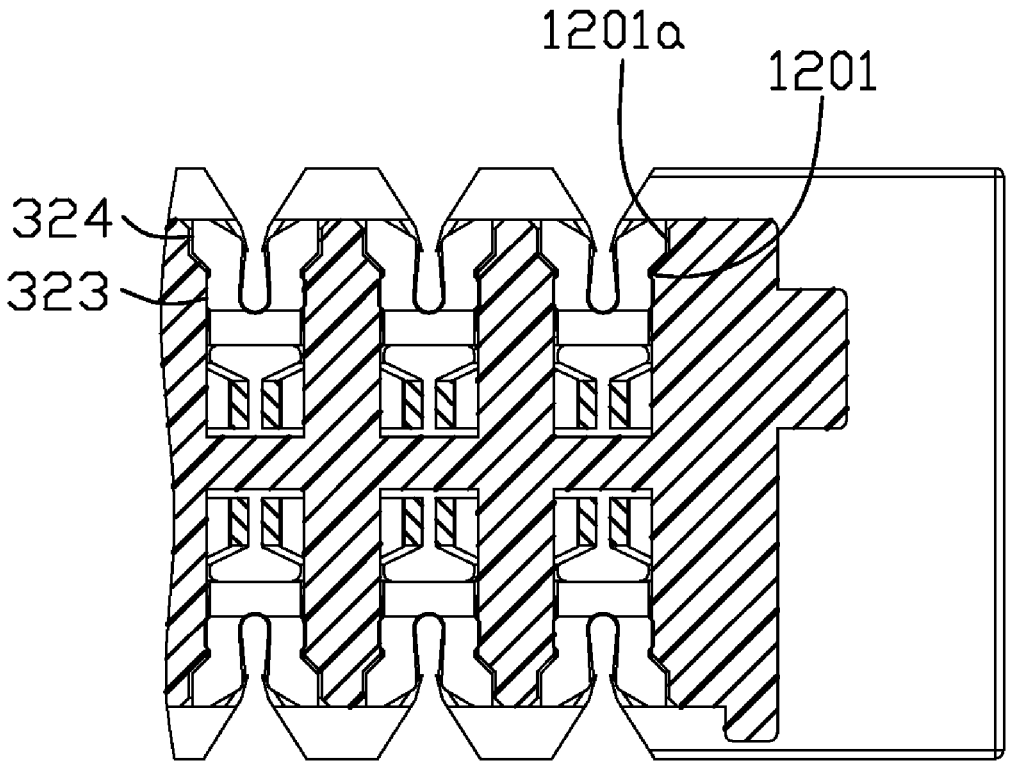
FIG. 6 is a section view illustrating the contact and the housing fitted to each other along 5-5 line.
Figure 7:
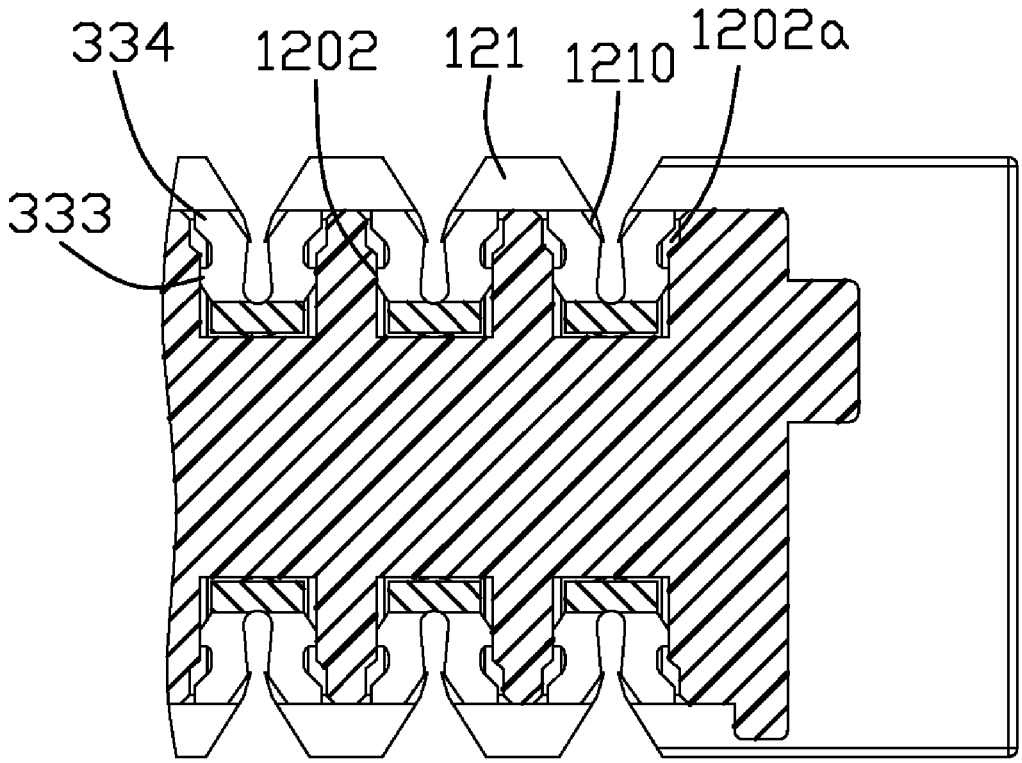
FIG. 7 is a section view illustrating the contact and the housing fitted to each other along 6-6 line.

Referencing to FIG. 5, the contact 3 is an insulation displacement contact and made from electric material stamped from sheet metal. The contact 3 comprises a connecting portion or a base portion 30, a first and second pair of insulation displacement portions 32, 33 respectively vertically extending from the two ends of the connecting portion 30, and a resilient contact 31 extending from the two longitudinal sides of the connecting portion 30. The connecting portion 30 is substantially of flat configuration expect its two upswept ends. Each of the first pair of insulation displacement portions 32 is substantially of an inverted-J shape with a flat upper surface 322 and has a cutout 320 on the middle of the outside thereof. The inner sides of the two first insulation displacement portions 32 are connected to each other on their base for forming a slot 321 with a narrower opening 3210 and a larger bottom 3212. Each of the second pair of insulation displacement portions 33 is substantially of a C type with a flat upper surface 332 and has a notch 330 on the middle of the outside thereof. The inner sides of those two second insulation displacement portions 33 are connected to each other on their base for forming a slot 331 with a narrower opening 3310 and a larger bottom 3312. Each of the insulation displacement portions 32 (33) has a touching portion 323 (333) for interferingly mating with the housing 1, and a limb 324 (334) on the top thereof. The resilient contact 31 includes a pair of contact engaging arms 310 respectively extending from the middle of the two sides of the connecting portion 30. Each contact engaging arm 310 is substantially of an S shape and extends along the mating direction for matching with a complementary contact. Each of the first and second contact engaging arms includes a mating tips 313 extending beyond the first insulation displacement contact portion 32. When the contact 3 is inserted into the contact holding groove 120, each touching portion 323 (333) of the insulation displacement portions 32 (33) interferingly matches with the fastening portion 1201 (1202) of the housing 1, and each of the limb 324 (334) is received in the receiving cutout 1201*a* (1202*a*) of the housing 1. The resilient contact 31 is interferingly inserted into the contact holding groove 120 of the housing. When the wire 4 is inserted into the insulation displacement contact 3, a part of insulation cover of the wire 4 would be peeled by the insulation displacement portions 32, 33 for being electrically connected to the contact 3.

While the foregoing description includes details which will enable those skilled in the art to practice the invention, it should be recognized that the description is illustrative in nature and that many modifications and variations thereof will be apparent to those skilled in the art having the benefit of these teachings. It is accordingly intended that the invention herein be defined solely by the claims appended hereto and that the claims be interpreted as broadly as permitted by the prior art.

What is claimed is:

1. An electric connector for mating with a complementary connector, comprising:

an insulation housing, comprising two rows of contact holding portions which are respectively arranged on an upper and lower sides of the insulation housing, and two rows of cable holding portions which are arranged in correspondence with the contacting holding portions and each connected to its corresponding contacting holding portion for forming a passageway along a mating direction;

at least an insulation displacement contact held in one of the contact holding portions, and comprising two pairs of insulation displacement portions; and at least an insulated wire extending along the mating direction, which includes a front portion inserted into one of the insulation displacement contact along a vertical direction and a sub-front portion received in one of the cable holding portions along the vertical direction; wherein said housing comprises two pairs of fastening portions respectively corresponding to the two pairs of insulation displacement portions for holding the two pairs of insulation displacement portions, each of said insulation displacement portions comprises a limb on the top thereof, each of said fastening portion comprises a receiving cutout for receiving said limb.

2. The electric connector as claimed in claim 1, wherein said insulation displacement contact further comprises a resilient contact which are absolutely under the insulation displacement portions, said two pair of insulation displacement portions each comprises a touching portion, a width between each said pair of touching portions is narrower than a width of the resilient contact.

3. The electric connector as claimed in claim 2, wherein when said insulation displacement contact is inserted into its corresponding contact holding portion of the housing, the touching portions of the two pairs insulation displacement portions and a pair of contact engaging arms respectively interferingly match with the housing.

4. An electrical connector assembly comprising:

an insulative housing defining a plurality of passageways therein;

a plurality of contacts disposed in the corresponding passageways, respectively, each of said contacts defining a connection portion lying in a horizontal plane, and at least one insulation displacement portion extending from the connection portion and lying in a vertical plane perpendicular to said horizontal plane;

a plurality of wires connected to the corresponding contacts, respectively; wherein in each of said contacts, an inner side edge of said planar insulation displacement portion mechanically and electrically connects to the corresponding wire while an outer side edge of said planar insulation displacement portion retains said contact to the housing, said planar insulation displacement portion extends from one lengthwise end of the connection portion, and each of said contacts further includes another planar insulation displacement portion extending from the other lengthwise end of the connection portion, and a pair of contact arms extend from the connection portion toward said planar insulation displacement portion in a horizontal direction and commonly define a mating direction parallel to said horizontal plane, and free mating tips of said pair of contacts arms extend beyond said planar insulation displacement portion in said horizontal direction.

* * * * *